United States Patent [19]

Karkiewicz

[11] 4,449,827

[45] May 22, 1984

[54] MIXING DEVICE

[75] Inventor: Kenneth G. Karkiewicz, Richmond, Va.

[73] Assignee: Ethyl Molded Products Company, Richmond, Va.

[21] Appl. No.: 437,733

[22] Filed: Oct. 29, 1982

[51] Int. Cl.[3] ..... B01F 15/02; B01F 5/12

[52] U.S. Cl. ..... 366/131; 366/262; 366/275; 417/536

[58] Field of Search ..... 366/262, 267, 275, 348, 366/349, 131, 136, 137; 417/534, 536, 537, 535, 479

[56] References Cited

U.S. PATENT DOCUMENTS

| | | | |
|---|---|---|---|
| 258,226 | 5/1882 | Gergens | 366/131 |
| 3,034,450 | 5/1962 | Kruckeberg | 417/536 |
| 3,039,399 | 6/1962 | Everett | 417/536 |
| 3,461,808 | 8/1969 | Nelson | 417/479 |

*Primary Examiner*—Robert W. Jenkins

*Attorney, Agent, or Firm*—Donald L. Johnson; John F. Sieberth

[57] ABSTRACT

This invention relates to a device for thoroughly mixing the liquid contents of first and second containers without exposing either the liquid contents or the resultant mixture to outside contamination. The device features a movable pumping diaphragm which traverses a pumping chamber so that the pumping chamber is divided into an upper and lower chamber. In a first position, the diaphragm causes the upper chamber to have a reduced volume while the lower chamber has an increase volume. In a second position, the pumping diaphragm causes the lower chamber to have a decreased volume while the upper chamber has an increased volume. Valving assemblies are utilized in conjunction with both the upper and lower chamber to selectively allow for the ingress and egress of fluids from these chambers dependent upon the position of the pumping diaphragm.

20 Claims, 6 Drawing Figures

MIXING DEVICE

BACKGROUND OF THE INVENTION

There is a need for a device for thoroughly mixing, without exposure to contamination, the liquid contents of two containers whereby, after mixing, the resultant mixture will reside in each of the two containers. Such a device would be useful for, among other things, the sterile mixing of two medicinal liquids in their respective vials preparatory to administration of the mixture to a patient.

THE INVENTION

This invention relates to a device for thoroughly mixing the liquid contents of first and second containers without exposing either the liquid contents or the resultant mixture to outside contamination. The device of this invention features simplicity in construction and ease in operation. The mixing device features a flexible pumping diaphram which traverses a hollow pump chamber so that the chamber is divided into a separate upper chamber and a separate lower chamber. The pumping diaphram is movable to a first position which, simultaneously, decreases the volume of the lower chamber and increases the volume of the upper chamber. The pumping diaphram can also achieve a second position which, simultaneously, increases the volume of the lower chamber and decreases the volume of the upper chamber. Also provided are first and second valving systems associated with the upper chamber and third and fourth valving systems associated with the lower chamber. The first valving system is for opening and closing ingress of fluid from the first container into the upper chamber while the second valving system is for opening and closing egress of fluid from the upper chamber to the second container. The position of the first and second valving system is dictated by the position of the pumping diaphram, i.e., the first and second valving system will be opened and closed, respectively, when the pumping diaphram is in its first position and will be closed and opened, respectively, when the pumping diaphram is in its second position. The third valving system is for opening and closing ingress of fluid from the second container into the lower chamber while the fourth valving system is for opening and closing egress of fluid from the lower chamber to the first container. Like the first and second valving systems, the third and fourth valving systems are dependent upon the position of the pumping diaphram for the position of the valving systems. Thus, the third and fourth valving systems will be opened and closed, respectively, when the pumping diaphram is in its second position, and will be closed and opened, respectively, when the pumping diaphram is in its first position. Also provided with the device of this invention is structure for moving the pumping diaphram from one of its positions to the other of its positions. This structure will preferably partially extend outwardly of the hollow pump chamber so that the operator of the device of this invention can have access to the structure to effect the movement necessary to move the pumping diaphram from position to position.

Preferably, the pumping diaphram and the first, second, third and fourth pumping systems are integrally formed one with the other. Even more preferred, is the case where the structure for moving the diaphram is also integrally formed with the pumping diaphram.

When the pumping diaphram, the various valving systems and the moving structure are integrally formed one to the other and are of a flexible thermoplastic material, this entire assembly of components can be made by simple injection molding techniques. Thus, a major component of the mixing device of this invention can be made as a single piece which will contribute to economy in manufacture and device assembly.

The pump chamber can be simply formed by a pair of mating hollow housings which are fitted together to form the pump chamber. When this construction is chosen, assembly of the mixing device is the paragon of simplicity since the pumping diaphram can be captured between the two housing parts so that it achieves its position of traverse across the pump chamber. To contribute to economy in manufacture, the two mating housings can be made of any rigid thermoplastic material and therefore, can be injection molded from such material.

In a preferred form, the moving structure can be biased so that the pumping diaphram is held in one of its positions. This bias of the moving structure is such that it can be overcome by simple finger pressure to move the moving structure so that the pumping diaphram will be in the other of its positions. Conveniently, the biasing of the moving structure can be accomplished by associating, with the moving structure, a coil spring and a button. The button is attached to the moving structure and in communication with the coil spring, such attachment and communication achieving the necessary association between the coil spring and the moving structure. The button can be of any convenient structure and material with thermoplastic materials being preferred due to their ease of formation into the necessary button structure by simple injection molding techniques.

The mixing device of this invention can be placed into fluid communication with the first and second containers by any acceptable mode as long as the communication is, for the most part, fluid tight and preventative of outside contamination of the two liquids or the resultant mixture. For example, communication can be achieved by the utilization of hollow tubing which extends from the containers to points of attachment carried by the mixing device, which points are in fluid communication with the above-described valving systems. Another possibility is realized by providing the mixing device with hollow penetrating structures which are in fluid communication with the valving systems and which can pierce entry diaphrams, e.g. septums used on the first and second containers. Such entry diaphrams are commonly used to provide entry of hypodermic needles to withdraw contents of a vial under sterile conditions.

These and other features of this invention contributing to satisfaction in use and economy in manufacture will be more fully understood when taken in connection with the following description of preferred embodiments and the accompanying drawings in which identical numerals refer to identical parts in which.

DESCRIPTION OF PREFERRED EMBODIMENTS

Figure 1:
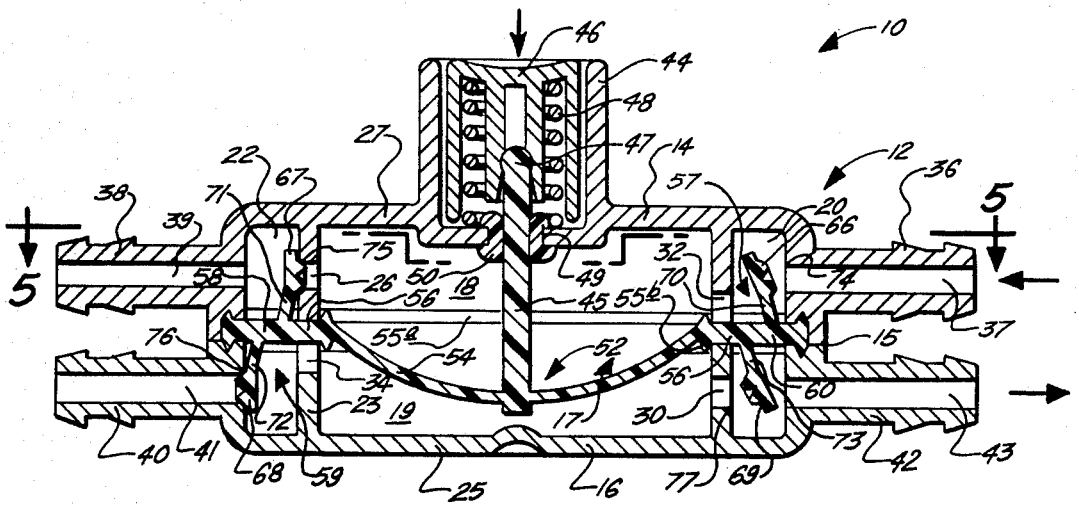
FIG. 1 is a sectional view of a mixing device of this invention showing the pumping diaphram in its first position.
Figure 2:
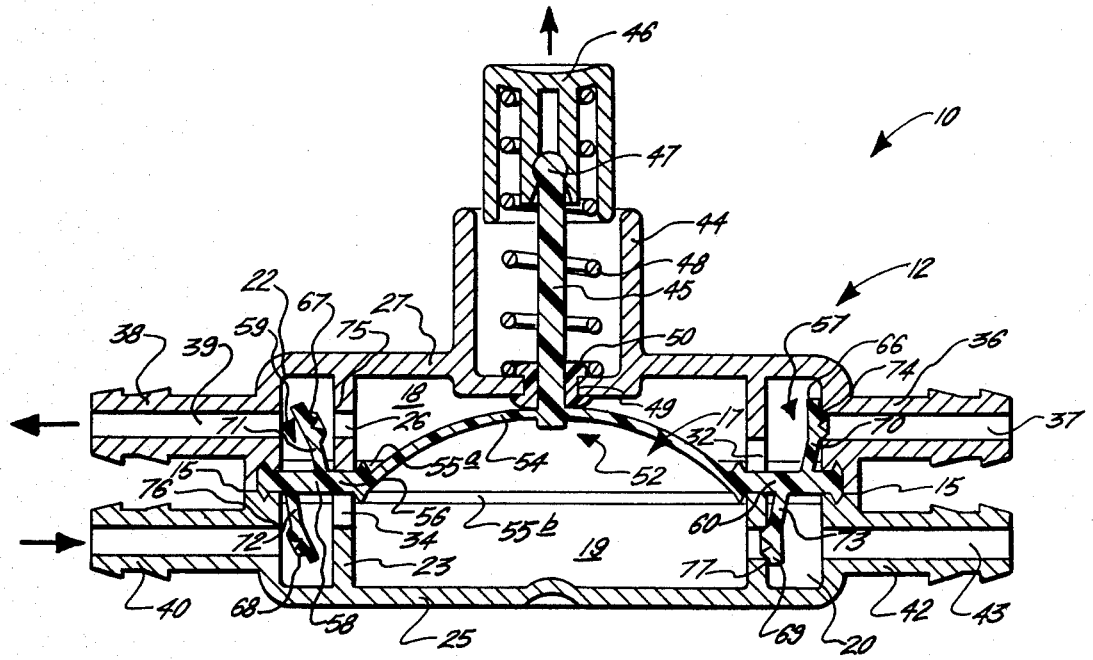
FIG. 2 is a sectional view of the mixing device shown in FIG. 1 with the pumping diaphram in its second position.
Figure 3:
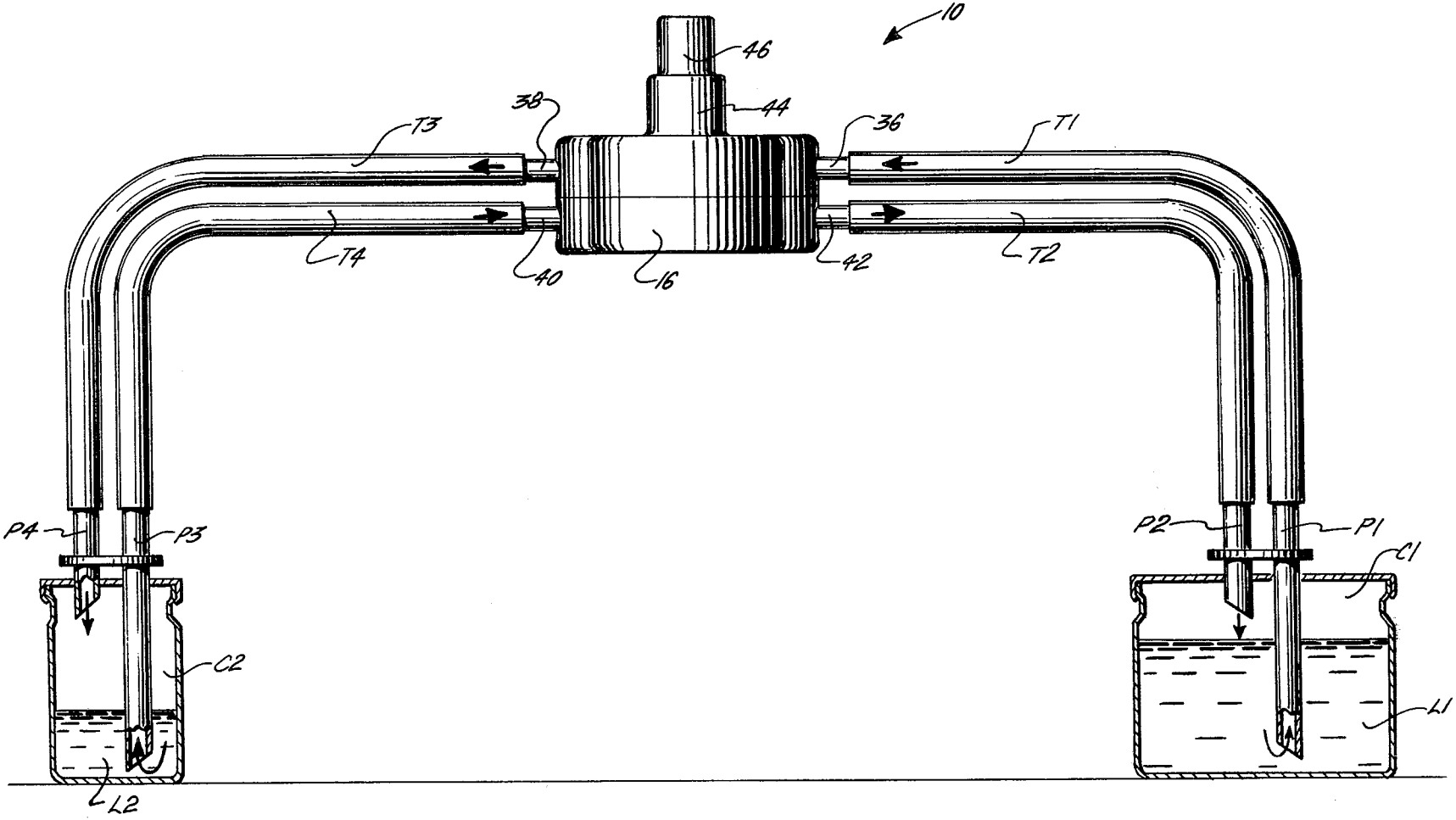
FIG. 3 is a side elevational view of the embodiment shown in FIG. 1 as it would be associated with two containers, the containers being shown in sectional view.
Figure 5:
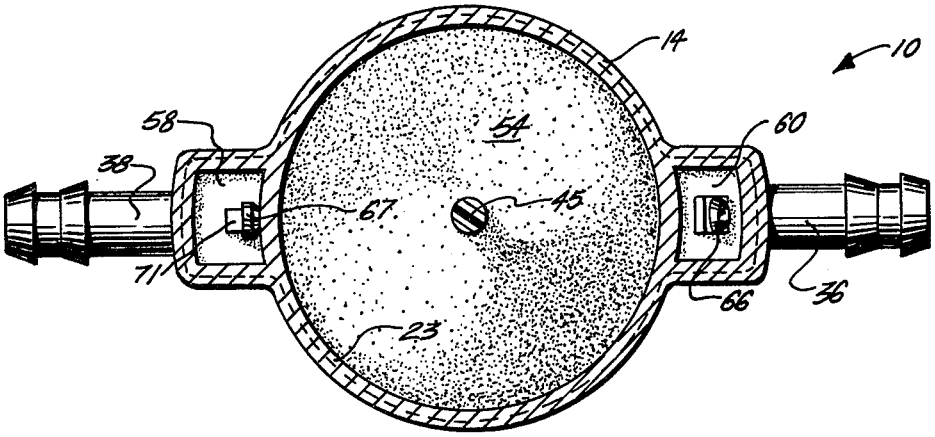
FIG. 5 is a sectional view taken through section lines 5—5 in FIG. 1.

Referring now to FIGS. 1-3, 5 and 6, there can be seen a mixing device of this invention, generally designated by the numeral 10. Mixing device 10 comprises a housing, generally designated by the numeral 12, which has, for its main portion, a circular shape when viewed in cross section, as can be seen in FIG. 5. For the embodiment shown, housing 12 comprises a housing top half 14 and a housing bottom half 16. These two housing halves meet together along a line which appears as seam line 15 as is seen in FIGS. 1-3. Formed by housing top half 14 and housing bottom half 16 is annular wall 23. Housing top half 14 additionally provides circular top wall 27 while housing bottom half 16 provides circular bottom wall 25. Circular top wall 27, circular bottom wall 25 and annular wall 23 together form pump chamber 17. In annular wall 23, to provide egress of fluid from pump chamber 17, are upper egress port 26 and lower egress port 30. Providing fluid ingress into pump chamber 17 are upper ingress port 32 and lower ingress port 34 which are also in annular wall 23. Adjoining pump chamber 17 and in fluid communication therewith via the just-discussed ports are valve housings 20 and 22. Valve housings 20 and 22 will each enclose a valve assembly hereinafter described. In fluid communication with valve housing 20 are upper ingress conduit 36 and lower egress conduit 42. To provide the prescribed fluid communication, upper ingress conduit 36 has hollow bore 37 while lower egress conduit 42 has hollow bore 43. Valve housing 22 also is provided with two conduits, upper egress conduit 38 and lower ingress conduit 40. Both of these conduits are provided with hollow bores, i.e., hollow bore 39 is provided for upper egress conduit 38 and hollow bore 41 is provided for lower ingress conduit 40. All of the conduits have about their peripheries, structures for assuring tight fitment of hollow tubing thereto.

Integral with circular top wall 27 is a hollow button housing 44 into which button 46 can be received.

Separation of pump chamber 17 into a separate upper chamber 18 and a separate lower chamber 19 is achieved by a circular flexible pumping diaphram, generally designated by the numeral 52. Pumping diaphram 52 has a flexible center portion 54. About the periphery of center portion 54 is thickened annular edge 56. Congruent and integral with the upper and lower extents of annular edge 56 are upper and lower bosses 55*a* and 55*b*. Note that both bosses also extend around the periphery of tabs 58 and 60. Bosses 55*a* and 55*b* form at least a part of that portion of pumping diaphram 52 which is captured between housing top half 14 and housing bottom half 16 when these two halves are joined together to form pump chamber 17. Thus captured, the bosses insure the positional integrity of pumping diaphram 52 with respect to pump chamber 17. Integrally formed to center portion 54 is actuating arm 45. Actuating arm 45 partially extends outside of pump chamber 17 through bore 49 formed in circular top wall 27. To effect fluid-tight passage of actuating arm 45 through bore 49, there is provided annular seal 50. At the upper end of actuating arm 45 is a knob portion 47 which achieves a snap fit attachment to button 46. This attachment causes actuating arm to move in the direction in which button 46 moves. Spring 48 is utilized to bias button 46 to the position shown in FIG. 2. As can be seen in this Figure, actuating arm 45 is in its outward-most position and the center portion 54 of pumping diaphram 52 is in a position different than that depicted in FIG. 1 in which button 46 is depressed against the biasing of spring 48.

Also integrally formed with central portion 54 are valving assemblies 57 and 59. Valving assemblies 57 and 59 each have a thickened tab portion designated by the numeral 60 and 58, respectively. Attached to thickened tab portion 60 are valves 66 and 69 by way of flexible arms 70 and 73, respectively. For valve assembly 59, thickened tab 58 has attached thereto valves 67 and 68 by way of flexible arms 71 and 72, respectively. Each of the valves provides a frustro-conical face which can achieve a fluid-tight seal when seated in the mouth of a bore or port as the case may be. It is to be understood that the valves may have other face configurations, for example, the valve faces can have a hemispherical configuration. Valve 66 seats on the annular shoulder 79 of bore 37 while valve 69 seats on annular shoulder 77 of lower egress port 30. Further, valve 67 seats on the annular shoulder 75 of upper egress port 26 while valve 68 seat on the annular shoulder 76 of bore 28.

For the embodiment shown in the drawings, pumping diaphram 52 is integrally formed with actuating arm 45 and valve assemblies 57 and 59. This entire integral assembly is preferably made of a material which is flexible but sufficiently resistant to fracture under multiple flexings of center portion 54 and the before-described flexible arms 70, 71, 72 and 73. Suitable materials are polypropylene or polyethylene. When such materials are utilized, center portion 54 should have a thickness within the range of from about 0.005 to about 0.100 inches. A preferred thickness range is from about 0.010 to about 0.030 inches. It is to be understood, however, that while polypropylene or polyethylene may be desirable, other elastomeric materials may be utilized, the only requirement being that they have sufficient flexibility and durability to achieve the pumping functions and be inert to the substances which are expected to be in contact with pumping diaphram 52.

As shown in FIG. 3, mixing device 10 can be associated with liquids $L_1$ and $L_2$ by way of hollow tubes $T_1$, $T_2$, $T_3$ and $T_4$. As shown in the drawings, $T_1$ is attached at one of its ends to upper ingress conduit 36 and that the other of its ends to a pipette $P_1$ which has its terminal end below the level of $L_1$ in container $C_1$. Tubing $T_2$ is attached to lower egress conduit 42 at one of its ends and at the other of its ends to pipette $P_2$ which has its terminal end well above the level of liquid $L_1$. Further, tubing $T_3$ is attached at one of its ends to upper egress conduit 38 and at its other end to pipette $P_4$ which has its terminal end above the level of liquid $L_2$ in container $C_2$. Connected to lower ingress conduit 40 is tubing $T_4$ which is connected to pipette $P_3$ which in turn has its terminal end submerged within liquid $L_2$.

To mix liquids $L_1$ and $L_2$, button 46 is first depressed so that pump diaphram 54 has the position shown in FIG. 1 which position will be called the first position. As can be seen in FIGS. 1 and 2, movement from the position of FIG. 2 to the first position, causes a change in the volumes of upper chamber 18 and lower chamber 19. In the first position, lower chamber 19 is reduced in volume while chamber 18 is simultaneously increased in volume.

In the first position, valve 66 is opened due to the drawing of a partial vacuum in upper chamber 18 due to its increase in volume size. The flexibility of arm 70 allows the movement of valve 66 to this open position. This partial vacuum will cause liquid $L_1$ to be drawn into $T_1$ so that it is drawn into bore 37, around valve 66 and on into upper chamber 18 via port 32. Simultaneous with the drawing of liquid $L_1$ into upper chamber 18, valve 67 will be in the closed position due to the partial vacuum found within upper chamber 18.

Simultaneous with the above-described positions for valves 66 and 67, the increase in fluid pressure within lower chamber 19 will cause valves 69 and 68 to be in an open and closed position, respectively. Due to, in the first position, the decrease in volume of lower chamber 19 there is a fluid pressure build up within lower chamber 19. This build up in pressure flexes flex arm 73 so that valve 69 opens to allow any fluid within lower chamber 19 to pass through port 30 to hollow bore 43 and ultimately to tubing $T_2$ so that such fluid can enter container $C_1$. Valve 68, on the other hand, will be in the closed position to prevent any fluid movement out of lower chamber 19 through hollow bore 41.

After pressure is released from button 46, the bias of spring 48 will cause button 46 to assume the position shown in FIG. 2. This, of course, will cause center portion 54 of pumping diaphram 52 to move upwardly thereby increasing the volume of lower pump chamber 19 and to decrease the volume of upper pump chamber 18. When the volume of upper pump chamber is decreased, valve 67 is forced to the open position and is allowed to assume such due to the flexibility of flexible arm 71. Any fluid within upper pumping chamber 18 will be forced through upper egress port 26 into port 39 and onto tubing $T_3$ where such fluid will be deposited within container $C_2$. During the position as shown in FIG. 2 which will be called the second position, valve 66 will be in the closed position due to fluid pressure build up caused by the decrease in the volume of upper pumping chamber 18.

Simultaneously with the decrease in volume of upper chamber 18, there will be an increase in volume in lower chamber 19. This increase in volume will cause a partial vacuum in the liquid lower chamber 19. The partial vacuum will result in $L_2$ being drawn into tubing $T_4$ so that it may pass through bore 41 into lower pumping chamber 19 via port 34. The partial vacuum moves valve 68 to the open position. The flexing of flex arm 72 allows such movement. Valve 69 is moved to the closed position by this same partial vacuum.

The above-described function of mixing device 10, as it goes through a complete cycle, i.e., moves from the position shown in FIG. 1 to the position shown in FIG. 2, will be repeated numerous times to achieve the mixing desired. It has been found that when the upper and lower chambers have a maximum expanded volume of 25 mls, that 10 to 50 cycles are needed to achieve adequate mixing of vials having a liquid volume of up to about 500 mls. To aid the above-described valves to achieve their closed position, it has been found beneficial to mold them so that the flexible arms are biased to hold the valves in the closed position. Due to the flexibility and resiliency of the flexible arms, the valves can still achieve their open position with a good degree of fidelity.

It should also be understood that mixing device 10 may need to be operated through its cycle a number of times to achieve priming of the pumping system. It is obvious that during the first few cycles, very little liquid will be passing through the upper and lower pumping chambers, but rather fluid in the form of air will be passed. However, this is of little concern in most applications since the distances between mixing device 10 and the containers from which the liquids are to be pumped are relatively close.

Figure 4:
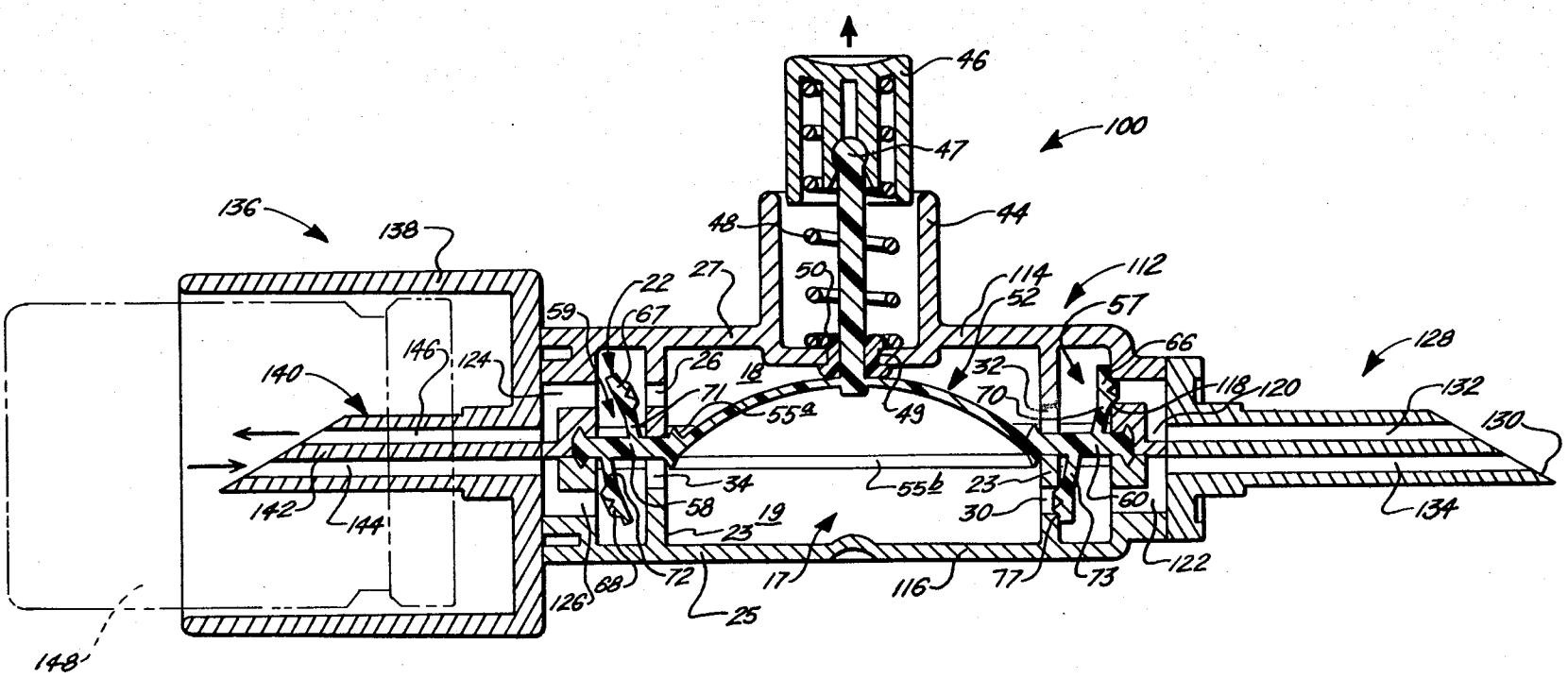
FIG. 4 is a sectional view of a second embodiment of this invention.
Figure 6:
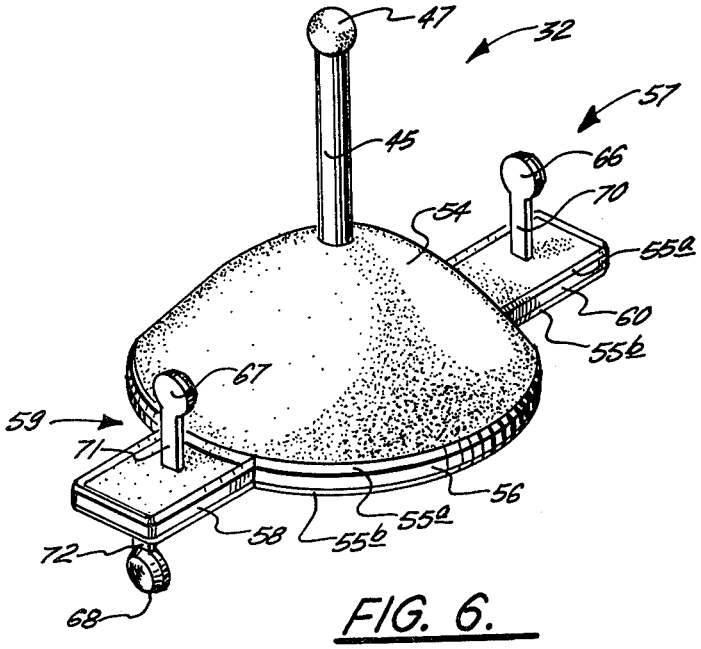
FIG. 6 is a perspective view of an integrally molded assembly which comprises the pumping diaphram, valving systems and moving structure shown in FIGS. 1, 2, 4 and 5.

In FIG. 4, a second embodiment of this invention is shown which is similar, in structure and functionality, to the first embodiment shown in FIGS. 1–3. The second embodiment differs from the first embodiment in that it is provided with structure which achieves fluid communication with the two containers by the piercing of septums utilized to close off the containers. Other than the foregoing difference and the resultant structure to achieve same, the configuration and function of many parts of both embodiments are identical. Therefore, the description utilized in describing these identical parts and their function for the first embodiment is equally applicable to this second embodiment and thus, will not be repeated. Identical parts can be identified as those parts which are given identical numerals in the drawings. For example, as can be seen from FIG. 4, the button assembly, which comprises button 46, coil spring 48, button housing 44, bore 49 and seal 50, for the second embodiment is identical in function and design with the button assembly of the first embodiment. Also, for the second embodiment, the configuration of the flexible pumping diaphram 52, the actuating arm 45 and valving assemblies 59 and 57 is identical to the one utilized in the first embodiment. To that end, FIG. 6 is equally applicable to this second embodiment of FIG. 4 as it is to the first embodiment. The housing of the second embodiment is very similar to housing 12 of the first embodiment in that pump chamber 17, and the upper and lower chambers 18 and 19, are identical in configuration. Also, annular wall 23 of the first embodiment is likewise utilized in the second embodiment along with upper and lower egress ports 26 and 30 and ports 32 and 34. Also, circular top wall 27 and 25 are identical for both embodiments.

Further, since the functional operation of the first and second embodiments is identical, the cyclic operation of the second embodiment is also not repeated herein, the description of the functioning of the first embodiment being sufficient to describe the function of the second embodiment. Further, in the drawings, the second embodiment is shown with pumping diaphram 52 in only the second position—it being understood that the second embodiment also utilizes a first position which is identical to the first embodiment position shown in FIG. 1.

The second embodiment mixing device of this invention, generally designated by the numeral 100, has a housing, generally designated by the numeral 112, which is very similar to housing 12 of the first embodiment. The main difference being that valve 66 seats against annular shoulder 118 of L-shaped bore 120. Bore 120's shape is part of housing top half 114. Housing bottom half 116 has, as a part thereof, L-shaped bore 122 which is in fluid communication with valve housing 20. In fluid communication with valve housing 22 and as a part of housing top half 114 is L-shaped bore 124.

Valve 68 achieves a fluid-tight seal against annular shoulder 115 which is at the mouth of L-shaped bore 126, which like L-shaped bore 122, is part of housing bottom half 116.

Affixed to the housing top and bottom halves and in fluid communication with L-shaped bore 120 and L-shaped bore 122 is needle 128. Needle 128 has an ingress bore 132 which is in fluid communication with L-shaped bore 120 and an egress bore 134 which is in fluid communication with L-shaped bore 122. Also, needle 128 has a sharp penetrating edge 130 suitable for piercing the septum of a container.

Also affixed to the joined housing top and bottom halves and in fluid communication with L-shaped bore 124 and L-shaped bore 126 is needle and shroud assembly 136 which comprises shroud 138 and needle 140. Needle 140 has an egress bore 146 which is in fluid communication with L-shaped bore 124 and an ingress bore 144 which is in fluid communication with L-shaped bore 126. A sharp edge 142 is provided for needle 140. As is depicted in the drawing, a septum closed vial 148 is positioned so that needle 140 pierces the septum and so that at least a portion of the vial is enclosed within shroud 138. Shroud 138 is useful in that it provides stability for vial 148 when needle 140 is positioned there within. It should be pointed out that a needle and a shroud assembly could also be provided in place of needle 128 for those cases in which the two liquids to be mixed are both contained in septum-covered vials. The embodiment in FIG. 4, however, only uses one shroud-needle assembly as this embodiment can be utilized to mix the contents of vial 148 with the contents of a drip bag assembly. Such a drip bag assembly is commonly utilized to intravenously administer medication to a patient. Since a shroud could interfere with piercing the drip bag septum, the shroud has been eliminated.

Fixing needle 128 and needle shroud assembly 136 to their respective positions onto mixing device 100 can be achieved either by threading, or any other conventional method. In a preferred form, both needle 128 and needle shroud assembly 136 can be made of thermoplastic materials which are injection-molded to the indicated configurations. In some instances, however, it may be desirable that needle 128 and needle shroud assembly 136 be made of metals which are conventionally used to form hypodermic needles and the like.

It is to be understood that while the foregoing description of the two mixing devices is directed towards their use in mixing two liquids, the mixing devices of this invention can also be used to mix a reconstituting liquid in one vial with a solid dissolvable in such liquid in another vial. In this latter case, air is initially pumped from the solid containing vial to the liquid containing vial. Also, contemporaneously, liquid will be pumped from the liquid containing vial to the solid containing vial . After the liquid has reached the solid containing vial, the solid is at least partially dissolved into solution. At that point, the pumping of air from the solid containing vial to the liquid containing vial will be replaced by the pumping of the solution to the liquid containing vial. Continuous liquid transfers between the two vials via the mixing device will finally achieve the thorough mixing desired and result in complete dissolving of the solid and bringing the resultant solution to its correct concentration. Exemplary of such dissolvable solids are water soluble freeze dried antibiotics which have received wide market acceptance.

I claim:

1. A mixing device for mixing together the liquid contents of a first and second container, whereby, after mixing, the resultant mixture resides in both containers, said mixing device comprising:

(a) a hollow pump chamber;

(b) a flexible pumping diaphram which traverses said pump chamber whereby said pumping chamber is divided into a separate upper chamber and a separate lower chamber, and whereby said flexible pumping diaphram is flexibly movable to a first position which, simultaneously, decreases the volume of said lower chamber and increases the volume of said upper chamber and to a second position which, simultaneously, increases the volume of said lower chamber and decreases the volume of said upper chamber;

(c) a first valving means for opening and closing ingress of fluid from said first container into said upper chamber and a second valving means for opening and closing egress of fluid from said upper chamber to said second container, said first and second valving means being opened and closed, respectively, when said flexible pumping diaphram is in said first position and being closed and opened, respectively, when said flexible pumping diaphram is in said second position;

(d) a third valving means for opening and closing ingress of fluids from said second container into said lower chamber and a fourth valving means for opening and closing egress of fluid from said lower chamber to said first container, said third and fourth valving means being opened and closed, respectively, when said flexible pumping diaphram is in said second position, and being closed and opened, respectively, when said flexible pumping diaphram is in said first position; and (e) moving means for moving said flexible pumping diaphram from one of its said positions to the other of its said positions.

2. The mixing device of claim 1 wherein said moving means is an actuating arm which is integrally formed, at one of its ends, with said flexible pumping diaphram and said actuating arm partially extends outwardly of said hollow pump chamber in a sealed manner.

3. The mixing device of claim 2 wherein said actuating arm is biased to an outward-most position to place said flexible pumping diaphram in one of its said positions, and said actuating arm being positionable in an inward-most position, against said bias, to place said flexible pumping diaphram in the other of its said positions.

4. The mixing device of claim 3 wherein said outward bias is provided by a compressible spring in communication with said actuating arm.

5. The mixing device of claim 1 wherein each of said valving means is integrally formed with said flexible pumping diaphram.

6. The mixing device of claim 1 wherein said first, second, third and fourth valving means each comprise a sealing portion having a frustro-conical surface for achieving a sealing seat against an annular shoulder which defines the point of said egress or said ingress, as the case may be, associated with each of said valving means.

7. The mixing device of claim 6 wherein said first, second, third and fourth valving means are integrally formed with said flexible pumping diaphram.

8. The mixing device of claim 1 wherein each of said valving means comprises a sealing portion carried by a flexible arm whereby a difference between the fluid pressure on one side of said sealing portion and the fluid pressure on the other side of said sealing portion, said difference being due to said flexible pumping diaphram moving from one of its said positions to the other of its said positions, will cause each of said flexible arms to bend in a direction which will move the sealing portion carried by each of said flexible arms so that each sealing portion achieves its particular opened or closed position.

9. The mixing device of claim 8 wherein said first, second, third and fourth valving means are integrally formed with said flexible pumping diaphram.

10. The mixing device of claim 9 wherein said flexible pumping diaphram and said valving means are of a thermoplastic material.

11. The mixing device of claim 10 wherein said thermoplastic material is polyethylene or polypropylene.

12. The mixing device of claim 11 wherein said flexible pumping diaphram has a thickness in the range of from about 0.025 inches to about 0.100 inches.

13. The mixing device of claim 11 wherein said flexible pumping diaphram, said sealing portions and said flexible arms are of a thermoplastic material and are integrally formed by injection molding of said thermoplastic material and wherein said injection molding forms said flexible arms so that said sealing portions are biased to their respective closed positions.

14. The mixing device of claim 13 wherein said flexible pumping diaphram has a thickness within the range of about 0.005 inches to about 0.100 inches.

15. The mixing device of claim 8 wherein said flexible pumping diaphram, said sealing portions and said flexible arms are of a thermoplastic material and are integrally formed by injection molding of said thermoplastic material, and wherein said injection molding forms said flexible arms so that said sealing portions are biased to their respective closed positions.

16. The mixing device of claim 15 wherein said first, second, third and fourth valving means each comprise a sealing portion having a frustro-conical surface, each of said frustroconical surfaces achieving a sealing seat against an annular shoulder which defines the point of said egress or said ingress, as the case may be, which is associated with each of said valving means.

17. The mixing device of claim 16 wherein said moving means is an actuating arm integrally formed, at one of its ends, with said flexible pumping diaphram and said actuating arm partially extends outwardly of said hollow pump chamber in a sealed manner.

18. The mixing device of claim 17 wherein said actuating arm is biased to an outward-most position to place said flexible pumping diaphram in one of its said positions, and said actuating arm being positionable in an inward-most position, against said bias, to place said flexible pumping diaphram in the other of its positions.

19. The mixing device of claim 18 wherein said thermoplastic material is polyethylene or polypropylene.

20. The mixing device of claim 19 wherein said diaphram is a thickness within the range from about 0.005 inches to about 0.100 inches.

* * * * *